United States Patent [19]

Ginardi

[11] Patent Number: 4,496,307

[45] Date of Patent: Jan. 29, 1985

[54] CANDLE INCLUDING FLAME ADJUSTMENT MEANS AND AUTOMATIC FLAME EXTINGUISHER MEANS

[75] Inventor: Jack L. Ginardi, Western Springs, Ill.

[73] Assignee: Valley Candle Mfg. Co., Inc., Brooklyn, N.Y.

[21] Appl. No.: 518,425

[22] Filed: Jul. 29, 1983

[51] Int. Cl.[3] ..... F23Q 25/00

[52] U.S. Cl. ..... 431/34; 431/146; 431/315

[58] Field of Search ..... 431/34, 144, 145, 146, 431/315, 344, 148, 152

[56] References Cited

U.S. PATENT DOCUMENTS

| | | | |
|---|---|---|---|
| 3,036,452 | 5/1962 | Renwick, Sr. et al. | 431/315 |
| 3,158,015 | 11/1964 | Renwick, Sr. et al. | 431/315 |
| 3,885,905 | 5/1975 | Giangiulio | 431/34 |

*Primary Examiner*—Randall L. Green
*Attorney, Agent, or Firm*—Jerome Goldberg

[57] ABSTRACT

A candle for varying the flame intensity and extinguishing the flame when the candle becomes unstable. The candle includes a receptacle containing combustible fuel and terminating into an open end covered by a cap means having a central opening. An externally threaded hollow tubular member is secured to the cap. A wick extends through the cap opening and the tubular member, so that an upper tip of the wick protrudes out from the cylindrical member to provide the location for the candle flame, and a lower portion of the wick is immersed in the fuel. A flame adjuster for varying the intensity of the flame includes a collar and a ledge between the upper part and lower part of the collar. The collar is internally threaded to engage and move along the tubular member, to decrease the flame when moving upward and to increase the flame when moving downward. A flame extinguisher means comprising a hollow body terminating at the upper end into a shoulder with a hollow central neck extending upward therefrom. The extinguisher means encircles the flame adjuster, so that the shoulder normally rests on the ledge of the collar and the neck encircles the upper part of the collar. The internal diameter of the neck is slightly larger than the external diameter of the collar to permit easy upward movement of the extinguisher means to extinguish the flame. The ledge is spaced from the inside wall of the body to permit slight lateral movement of the extinguisher means, so that the neck may firmly contact the upper part of the collar to vary the position of the collar for adjusting the flame intensity.

13 Claims, 8 Drawing Figures

CANDLE INCLUDING FLAME ADJUSTMENT MEANS AND AUTOMATIC FLAME EXTINGUISHER MEANS

BACKGROUND OF INVENTION

This invention relates generally to a candle using liquid fuel and more specifically relates to a candle having adjustment for the flame intensity, and still more particularly relates to a candle using liquid fuel and having automatic flame extinquisher means.

In the past, candles using liquid fuel have been constructed to provide adjustment of the intensity of the candle flame and included means for automatically snuffing out the candle flame when the candle became unstable or tipped over. This type of candle is disclosed in U.S. Pat. No. 3,158,015 (1964), Inventor F. W. RENWICK, SR. ET AL, and entitled "Artificial Candle," and comprised a container for liquid fuel terminating in an upper opening. A cap closed the container opening and included a central hole. An externally threaded cylindrical member was positioned in the hole. A wick portion protruded out from the upper end of the cylindrical member to provide the cite for the flame, and the wick extended downward therefrom through the cylindrical member and the hole in the cap, so that the bottom portion of the wick was immersed in the fuel. An internally threaded tube engaged the cylindrical member for moving upward and downward on the cylindrical member for varying the intensity of the flame. The outside surface of the tube was constructed into an hexagonal configuration. A bell shaped snuffer enclosed the cylindrical member and the tube, and included a dome and a neck extending upward therefrom having an hexagonal inside surface for receiving the complementary hexagonal surface of the tube. The rotating of the bell snuffer would cause the tube to move upward or downward for varying the flame intensity. If the candle was tipped over or became unstable it was intended that the bell snuffer would responsively move outward and over the flame to extinquish the flame.

The aforedescribed U.S. Pat. No. 3,158,015, afforded positive means for adjusting the candle but at times would not respond to move outward for extinquishing the flame. This malfunction was attributed to the frictional contact of the ribs of the tube in the grooves of the neck of the bell snuffer of the complementary hexagonal surfaces. Moreover, when the bell snuffer did automatically move outward away from the candle to extinquish the flame, there was nothing to retain the bell snuffer in place, so that often times the bell snuffer was not repositioned on the candle for subsequent use.

U.S. Pat. No. 3,885,905 (1975), Inventor CLAYTON GIANGIULIO, and entitled "Candle with Automatic Snuffer" describes a candle having a container with liquid combustible fuel terminating into an open neck. A cap member comprising a flanged side wall, a conical wall and a central cylindrical hub, integrally connected as one piece was positioned over the neck of the container. A wick folded over itself is looped over a pin attached to the upper end of the cylindrical hub, and thereby positioning the wick tip on the outside of the hub to serve as the cite for the flame. A hollow snuffer of conical shape is loosely coupled to the cap member and is freely rotatable about the axis of the cylindrical hub, to move outward and extinquish the flame when the candle was suddenly impacted or tipped over.

The GIANGIULIO candle, due to the loose coupling and freely rotatable feature of its snuffer, provided suitable means for automatically extinquishing the flame, but had no provision for controlling flame intensity. The subject invention provides control of flame intensity and also affords positive means for automatically snuffing out the flame during an unstable condition of the candle.

SUMMARY OF THE INVENTION

The candle of this invention comprises a receptacle for combustible fuel and terminating into an open end closed by a cap member having a central hole. An externally threaded tubular member is secured to the cap. A wick extends through the cylindrical member and the cap, so that an upper portion of the wick protrudes out from the cylindrical member to provide the wick tip where the candle flame is located and a lower portion of the wick is immersed in the fuel. A flame adjuster engages the cylindrical member to move therealong for varying the flame intensity. A flame extinquisher means is supported on the flame adjuster. The flame extinquisher automatically and easily moves outward to cover and extinquish the flame when the candle becomes unstable. Retainer means are provided on the flame adjuster to prevent the flame extinquisher from disassociating itself from the candle.

The flame extinquisher may be moved slightly in the lateral direction, so that firm frictional contact is made with the flame adjuster, to enable positive rotation of the flame adjuster for varying the flame intensity.

The flame adjuster comprises a collar internally threaded to engage the tubular member. A rim is formed to the outside of the collar between the upper part and the lower part of the collar. The flame extinquisher comprises a hollow body terminating into a shoulder having a neck protruding upward therefrom. An opening in the neck and shoulder communicates with the inside of the body. The flame extinquisher encircles the collar and the shoulder is supported on the rim of the collar. The neck has an internal diameter just slightly larger than the outside diameter of the upper part of the collar, but of sufficient dimension to prevent any inhibitory friction between the adjacent surfaces of the neck and upper part of the collar, when the neck and body of the flame extinquisher move outward for extinquishing the flame during an unstable condition of the candle.

The upper end of the neck of the flame extinquisher and the upper end of the upper part of the collar of the flame adjuster are substantially aligned, and, therefore, just a slight upward movement of the flame extinquisher enables the end of the neck to clear the end of the collar when snuffing out the flame. This prevents the possibility of the collar obstructing the operative movement of the flame extinquisher.

Accordingly, it is a primary object of the invention to provide a candle including means for varying the flame intensity and means for extinquishing the flame when the candle tilts over or becomes unstable.

Another object is to provide a flame extinquisher which operates easily and dependably for extinquishing the flame during an unstable condition of the candle.

A primary feature of the invention is to provide a flame extinquisher including a body and a neck protruding upward therefrom having a circular internal surface for encircling a circular outer surface of the upper part of the collar of the flame adjuster, so that the adjacent surfaces of the neck and upper part of the collar do not inhibit the operative movement of the flame adjuster.

Another primary feature is to provide a flame extinquisher supported on a flame adjuster, so that any outward or inward movement of the flame adjuster does not vary the position of the flame extinquisher with respect to the flame adjuster.

Another feature is to form the neck of the flame extinquisher so that the radius of the internal surface thereof is slightly greater than the radius of the external surface of the upper part of the collar, to enable free outward movement of the flame extinquisher.

Another feature is to provide slight lateral movement of the flame extinquisher against the flame adjuster, so that firm frictional contact may be made for achieving positive rotation of the flame adjuster to vary the flame intensity.

DESCRIPTION OF DRAWING

Referring to the drawing in which the same characters of reference are employed to indicate corresponding similar parts throughout the several figures of the drawing:

FIG. 2 is a fragmentary view showing the flame extinquisher and flame adjuster spaced from the cap and cylindrical member with the wick extending through;

DESCRIPTION OF THE PREFERRED EMBODIMENT

Figure 1:
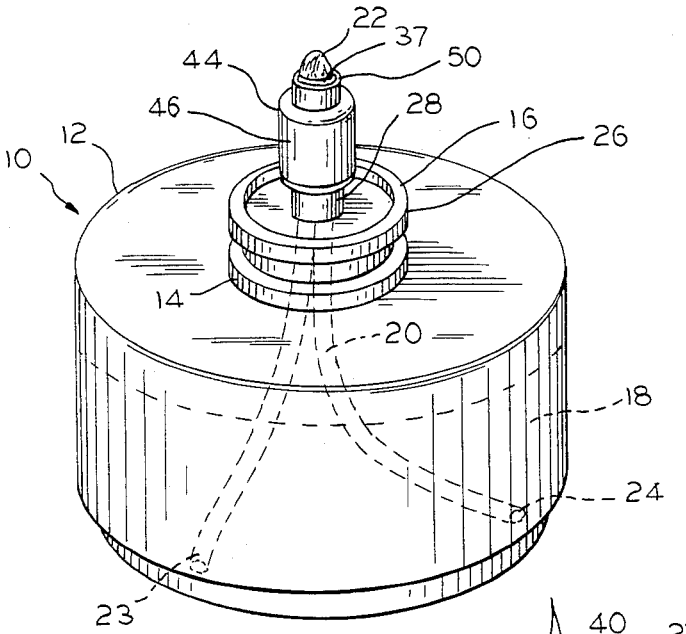
FIG. 1 is a perspective view of the candle embodying the principals of the invention.

Referring now to FIG. 1 of the drawing, the reference numeral 10 indicates generally a candle comprising a container 12 terminating into an open neck 14. A cap 16 closes the neck 14. The container 12 stores liquid combustible fuel 18 such as kerosene or the like.

A wick 20 includes an outermost tip 22 on the outside of the candle and an inner portion extending into the fuel 18. The wick 20 is a length of rope or braided material folded at an intermediate point forming the tip 22 and the opposed portions are folded on itself and the opposite ends 23 and 24 are positioned adjacent to each other for inserting into the fuel 18 (FIG. 1).

The cap 16 includes a dish portion 26 having a hub 28 centrally located in the dish 26. A hollow cylindrical member 30 threaded on the outside thereof extends upward from the hub 28. The cylindrical member 30 includes an annular base 32 pressfitted into the hub 28 (FIGS. 4 and 5).

Figure 3:
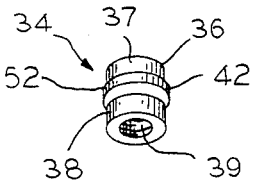
FIG. 3 is a perspective view of the flame adjuster.

A flame adjuster 34 (FIG. 3) comprises a hollow collar or tube 36 having an upper part 37 and a lower part 38. The inside wall 39 of the lower part 38 of the collar 36 is threaded, to threadedly engage the cylindrical member 30. The intensity of the flame 40 is decreased as the flame adjuster 34 is moved further upward (FIGS. 4 and 5), and, conversely, the flame intensity is increased as the flame adjuster is moved further downward. An annular ledge or rim 42 (FIGS. 3,4 and 5) is integrally formed to the outside of the collar 36 between the upper part 37 and lower part 38.

Figure 4:
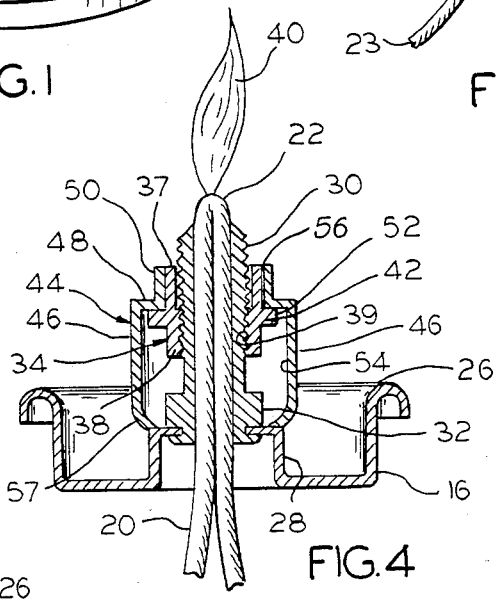
FIG. 4 is an enlarged cross-sectional view of the upper part of the candle and showing the candle flame at the tip of the wick.
Figure 7:
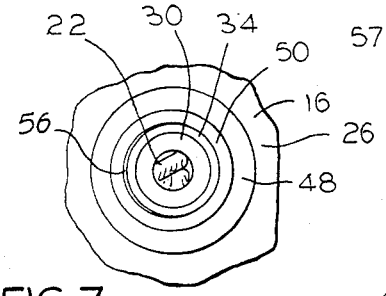
FIG. 7 is a top view of the candle.
Figure 5:
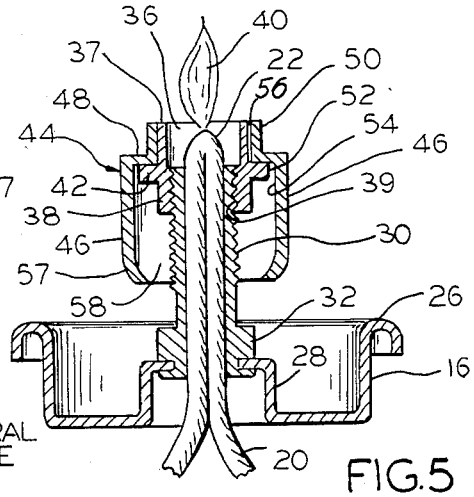
FIG. 5 is a cross-sectional view of the candle similar to FIG. 4, but showing the flame adjuster at a higher level to cause a decrease in the magnitude of the flame.

A flame extinquisher means indicated generally by the reference numeral 44 (FIG. 1) normally rests on the ledge 42 of the flame adjuster 34 (FIGS. 4 and 5). The flame extinquisher 44 is hollow and includes a cylindrical body 46, an annular shoulder 48 terminating the upper end of the body 46, and a centrally positioned neck 50 extending upward from the shoulder 48. The inside diameter of the neck 50 is just slightly larger than the outside diameter of the upper part 37 of the collar 36 of the flame adjuster 34. Therefore, the neck 50 may have some contact with collar 36 but is at least partially spaced from the collar 36, to enable free outward movement of the neck 50 when the candle is unstable. The outer end of the neck 50 and the outer end of the collar 36 are normally substantially aligned, so that the neck 50 and body 46 may easily hurdle the upper part 37 of the collar 36 when moving outward to extinquish the flame during an unstable condition for the candle 10.

Figure 8:
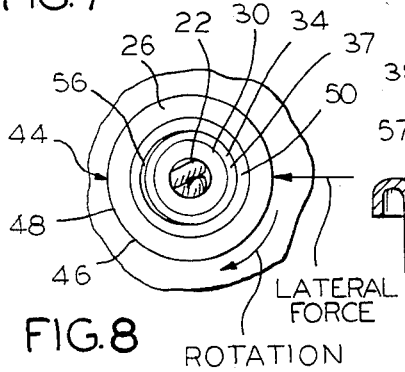
FIG. 8 is a top view of the candle to illustrate the lateral and rotational forces applied to the body of the flame extinquisher for adjusting the position of the flame adjuster to vary the flame intensity.

As shown in FIGS. 4 and 5, the outer annular edge 52 of the ledge 42 is spaced from the inside surface 54 of the body 46 of the flame extinquisher 44. Now referring to FIG. 8, it will be seen that a lateral pressure against the outside of the body 46 causes frictional contact of a portion of the neck 50 with the opposed portion of the upper part 37 of the collar 36, and the opposite side of the neck 50 and the upper part 37 of the collar 37 have a space 56 therebetween. Thus, by applying slight lateral pressure to the body 46 of the flame extinquisher 44 and then rotating the body 46, the collar 36 rotates responsively, to move along the cylindrical member 30 in an upward direction or in a downward direction as desired. However, since the internal diameter of the neck 50 is just slightly larger than the outside diameter of the upper part 37 of the collar 36, the rotating and not applying any lateral force may cause sufficient frictional force for rotating the collar 36 and adjusting the position of the collar 36 along the cylindrical member 30. The lateral force, though, assures firm frictional contact and positive rotation of the collar in response to the rotation of the body 46.

Figure 2:
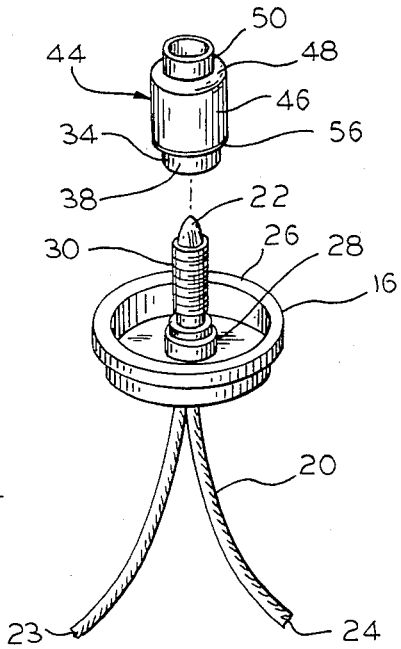
Figure 6:
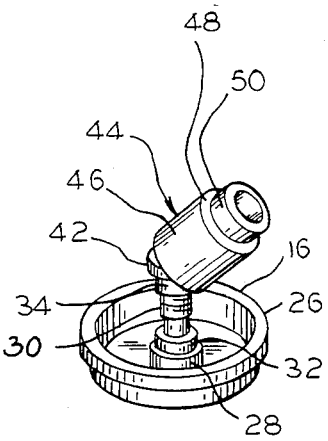
FIG. 6 illustrates the flame extinquisher positioned over the wick tip in the flame extinquisher position.

Turning now to FIG. 5, it will be seen that the bottom end 57 of the body 46 is tapered inward and defines the bottom opening 58. The opening 58 is dimensioned to permit passage of the lower part 38 of the collar 36 but to block passage of the ledge 42 of the collar 36. In FIG. 2, the lower part 38 protrudes out from the bottom opening 58 prior to engaging the tubular member 30. Since the radius of the bottom opening 58 is less than the radius of the outer edge 52 of the ledge 42 of the collar 36, the rim 42 also serves as a stop to prevent the flame extinquisher 44 from falling off the candle 10. FIG. 6 illustrates the limit of outward movement of the flame extinquisher 44 after being stopped by the ledge 42. In the limit position, the flame extinquisher 44 covers the tip 22 of the wick 20 and the flame 40 for extinquishing the flame.

The description of the preferred embodiment of this invention is intended merely as illustrative of the subject invention, the scope and limits of which are set forth in the following claims.

I claim:

1. A candle comprising:

a receptacle terminating into an open end;

a combustible fuel contained in the receptacle;

a cap covering said open end and having an opening therethrough;

a hollow tubular member secured to the cap;

a wick passing through said cap and tubular member, so that an upper tip portion of the wick protrudes out from the outermost end of the tubular member and a bottom portion of the wick extends into the fuel, said tip being the location for the candle flame;

a flame adjuster movable along said tubular member for varying the intensity of the flame, said flame adjustor including a support means secured to the outside thereof and having an upper side and a lower side; and a flame extinquisher means normally supported on said upper side of said support means, said flame extinquisher means being slightly movable in a lateral direction for contacting the flame adjustor to enable outward and inward adjustment of the position of the flame adjuster, said flame extinquisher means being freely movable in an outward direction to extend over the flame for extinquishing the flame when the candle tilts over or becomes unstable; and the lower side of the support means cooperating with the flame extinquisher means to prevent the flame extinquisher means from flying off the candle when said flame extinquisher extends over the flame.

2. A candle of claim 1, wherein said tubular member is externally threaded and said flame adjuster comprises:

a hollow collar internally threaded to threadedly engage the tubular member and to move therealong; and said support means being positioned on the outside of the collar between an upper part and lower part of the collar.

3. The candle of claim 2, wherein said support means is a circular ledge extending around the outside of said collar.

4. The candle of claim 3, wherein said flame extinquisher comprises:

a hollow cylindrical body;

a shoulder forming the upper end of the body; and a neck protruding outward from the shoulder, an opening extending through the shoulder and neck and in communication with the inside of the body, said flame extinquisher being positioned over said flame adjuster so that the shoulder normally rests on the upper side of the ledge of the collar and the neck encircles the upper part of the tubular member, the inside diameter of the neck being slightly larger than the outside diameter of the upper part of the collar.

5. The candle of claim 4, wherein the outer edge of the ledge is spaced from the inside surface of the body when the shoulder rests on the ledge, said flame extinquisher being slightly laterally movable so that a portion of the inside surface of the neck contacts an opposed outside surface of the upper part of the collar and thereby enabling the collar to rotate upon the application of a rotational force to the body of the flame extinquisher means.

6. The candle of claim 5, wherein the outer end of the neck is substantially aligned with the outer end of the tube of the flame adjuster.

7. The candle of claim 4, wherein said shoulder is an annular shape.

8. The candle of claim 4 includes:

an opening formed in the bottom end of the body having a diameter less than the diameter of the outer edge of said ledge, said bottom end contacting said ledge to prevent the body from falling off the candle when the shoulder of the body of the flame extinquisher means moves outward away from contact with the ledge for extinquishing the flame.

9. The candle of claim 8, wherein the bottom end of the body is tapered inward to define the bottom opening.

10. A candle comprising:

a receptacle for containing fuel terminating into an open end;

a cap covering said open end and having an opening therethrough;

an externally threaded hollow tubular member secured to the cap;

a wick passing through the cap and tubular member, so that an upper tip portion of the wick protrudes out from the outermost end of the tubular member and a bottom portion of the wick extends into the fuel, said tip being the location for the candle flame;

a collar internally threaded engages the tubular member, said collar including a ledge; and a flame extinquisher means normally supported on said ledge of the collar and freely movable in an outward direction to extend over the flame for extinquishing the flame when the candle tilts over or becomes unstable, said extinquisher means being laterally movable for contacting the collar and rotatable for causing the collar to rotate and move along the tubular member for varying the flame intensity.

11. The candle of claim 10, wherein the outside surface of the upper part of the collar is circular and said flame extinquisher comprises:

a cylindrical body;

a shoulder terminating the upper end of the body;

a neck protruding upward from the shoulder; and an opening formed in the shoulder to communicate the inside of the body with the inside of the neck, the internal surface of the neck is circular to encircle the upper part of the collar, the internal diameter of the neck being just slightly larger than the external diameter of the upper part of the collar.

12. The candle of claim 11, wherein said shoulder normally rests on said ledge, said body being rotatable upon the application of an external force to cause rotation of the collar.

13. The candle of claim 12, wherein said ledge is normally spaced from the inside surface of said body when the shoulder rests on the ledge, to permit slight lateral movement of the cylindrical body and cause firm frictional contact between a portion of the neck and opposed portion of the upper part of the collar, for enabling positive rotation of the collar.

* * * * *